US005356313A

United States Patent [19]

Niwa et al.

[11] Patent Number: 5,356,313

[45] Date of Patent: Oct. 18, 1994

[54] SHIELDED ELECTRICAL CONNECTOR AND MOUNTING FIXTURE THEREFOR

[75] Inventors: Takeo Niwa; Yoshitsugu Fujiura; Hiromitsu Kodama, all of Kawasaki, Japan

[73] Assignee: The Whitaker Corporation, Wilmington, Del.

[21] Appl. No.: 28,498

[22] Filed: Mar. 9, 1993

[30] Foreign Application Priority Data

Mar. 26, 1992 [JP] Japan ..... 4-4024929

[51] Int. Cl.[5] ..... H01R 13/648

[52] U.S. Cl. ..... 439/607; 439/567

[58] Field of Search ..... 439/95, 607, 609, 567, 439/82, 108, 571

[56] References Cited

U.S. PATENT DOCUMENTS

| | | | |
|---|---|---|---|
| 4,522,423 | 11/1985 | Swengel | 439/607 |
| 4,986,772 | 1/1991 | Fukutani | 439/892 |
| 5,055,069 | 10/1991 | Townsend et al. | 439/608 |
| 5,104,326 | 4/1992 | Smith et al. | 439/95 |
| 5,133,679 | 7/1992 | Fusselman et al. | 439/608 |
| 5,147,220 | 9/1992 | Lybrand | 439/567 |

FOREIGN PATENT DOCUMENTS

| | | |
|---|---|---|
| 103883 | 2/1986 | Japan . |
| 163082 | 10/1987 | Japan . |
| 84166 | 5/1989 | Japan . |

*Primary Examiner*—Eugene F. Desmond
*Attorney, Agent, or Firm*—Timothy J. Aberle

[57] ABSTRACT

The shielded electrical connector (10) has an insulating housing (20), a metal shell (30) and a pair of fasteners (40). The metal shell (30) has resilient fastening legs (33). The fastener (40) has a main leg (41) with resilient arms (42) at its end, which is inserted and retained in the opening (26) of the insulating housing (20). The auxiliary leg (45) is made at a right angle relative to the main leg and has a latching protrusion (46) on its outer surface which becomes engaged with the resilient fastening leg (33) of the metal shell (30). The resilient arms (42) of the fastener (40) are inserted into a through-hole of the printed circuit board, thus achieving the attachment of the electrical connector (10) to the board, while the connection to the grounding layer is performed by means of soldering.

13 Claims, 4 Drawing Sheets

SHIELDED ELECTRICAL CONNECTOR AND MOUNTING FIXTURE THEREFOR

FIELD OF THE INVENTION

This invention relates to electrical connectors, particularly shielded connectors with a matching surface covered by a metal shell and intended for connecting to printed circuit boards.

Connectors are widely used to interconnect electronic devices in personal computers, word processors, printers, copying machines, and similar office equipment. In order to prevent the signals carried by the cables connected to such connectors from leaking to other devices, shielded cables are used containing a number of wires placed inside a grounded conducting sleeve. The conventional practice for obtaining an electrical connection with a grounded conductor is to cover the matching surface of the electrical connector with a metal shell and connect it electrically to the grounding conductor of the respective printed circuit.

In order to secure the shielded electrical connectors to printed circuits, they are usually equipped with a fastener with resilient metal legs provided with barbs at their edges. The electrical connector is attached to the printed circuit by inserting this fastener into a through-hole of the printed circuit. The electrical connection is obtained by soldering the metal shell to the grounding conductor of the printed circuit board.

A number of methods for achieving a reliable electrical connection between the fastener and the metal shell are known in the art. For example, the method described in Japanese Utility Model Application No. 3-39901, consists of stamping the metal shell into a shield, and forming the resilient attachment into a single unit. Another method consists of joining the metal shell and the fastener with screws.

However, the first conventional method suffers from the disadvantage that the manufacturing of the metal shell and fastener as a single piece is complicated and costly, in that a special treatment for the insulating housing is needed.

In the second conventional method, the fasteners are joined to the metal shell by fitting them into square, channel-like depressions made at both edges of the insulating housing. The housing is attached to the back side of the metal shell by bolts and nuts, or bolts screwed into the threaded holes made in the housing, thereby providing for an electrical connection between the fasteners and the metal shell. The result is that in addition to the complicated configuration of the fasteners themselves, the assembly also requires the use of bolts, which causes lower performance efficiencies of the assembly. Such a design is acceptable for shielded electrical connectors to be used with panels to which they are attached by screws; however, when the connectors are connected directly to printed circuits, it is impossible to obtain a reliable electrical connection between the grounded parts.

Therefore, it is an object of the present invention to provide an electrical connector that is free of the above-mentioned disadvantages and can be used with and without bolts, while providing a reliable contact with the ground and the fastener used in such shielded electrical connectors.

SUMMARY OF THE INVENTION

The shielded electrical connector in accordance with the present invention consists of a long and narrow insulating housing provided with at least one fastener at each end, and a metal shell covering the matching surface of the housing. The fasteners comprise: a main leg which is press-fit and retained in the opening of the insulating housing and has resilient arms at the front end protruding from the housing; and an auxiliary leg which is bent at an approximately right angle and has a latching device at its outer surface. The metal shell has a resilient member into which the said latching device of the auxiliary leg fits.

The fastener according to this invention is made of a single piece of metal sheet bent in the shape of an "L" to form the main and auxiliary legs. The front end of the main leg has resilient arms and is inserted and retained in an opening in the insulating housing. The auxiliary leg which is made perpendicular to the main leg runs parallel to the matching surface of the insulating housing and has a latching device on its outer surface. This latching device provides a reliable electrical connection with a resilient member of the metal shell when the latter is assembled with the insulating housing of the shielded electrical connector.

DETAILED DESCRIPTION OF THE PREFERRED EMBODIMENT(S)

Figure 1:
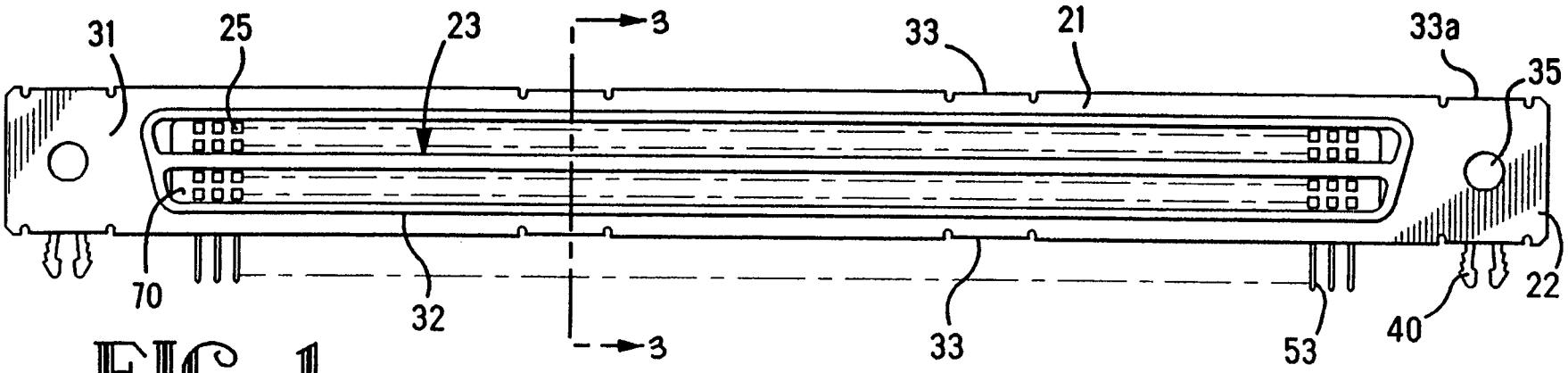
FIG. 1 is a front view of the instant invention's receptacle connector 10 as seen from the matching surface.

The connector 10 has an insulating housing 20 whose central portion 21 is made in the form of a relatively thin plate while the end sections 22 are relatively thick. A supporting plate 23 is made at the front of the central section 21 of the insulating housing 20 and contains two rows of contacts. Along the top and bottom surfaces of the central section 21 there are several ramp-shaped latches 24. At the top and bottom of the contact supporting plate 23 of the central section 21 there are contact retaining grooves 25. The insulating housing 20 is molded from an engineered plastic, preferably from a liquid crystal polymer (LCP).

The connector 10 also has a metal shell 30 covering at least a portion of the matching surface of the insulating housing 20, a pair of fasteners 40 which are inserted and retained in the through-holes 26 at both ends 22 of the insulating housing 20, and a tie-in plate 60 retaining the soldering tie-ins 53 of the contacts 50.

The metal shell is a unitary structure made by upsetting from, e.g., a 0.25 mm thick carbon steel material, and which consists of: a base plate 31 covering both ends of the matching surface; the approximately D-shaped tubular member 32 extending forward from the center of the matching surface and surrounding and protecting the contacting portions of the contacts 50; and a number of fastening legs 33 with an opening 34 bent at an approximately right angle at the top and bottom of the base plate 31. Round holes 35 are provided near both ends of the metal shell 30, so that bolts 80 may be used to attach it to the panel. All fastening legs 33 are of the same shape and dimensions; however, the fastening legs 33*a* shown in FIG. 1 are made longer than the other fastening legs.

As it will be explained below with reference to FIGS. 8–9, a fastener 40 is made in the shape of the letter "L" of a 0.6 mm thick steel plate which is nickel-plated and blanched at the ends. The main leg 41 of the fastener is pressed into the opening 26 of the insulating housing 20 from the top to the bottom, so that the pair of resilient arms 42 formed at the front end of the main leg 41 extends from the bottom surface of the insulating housing 20. The resilient arms 42 have sharp teeth at the edges, which cut into the surface of the through-hole of the element to which the connector 10 is attached, for example, a printed circuit board 97. A latch 46 is provided on the upper surface near the end of an auxiliary leg 45 formed at a right angle to the main leg. This auxiliary leg 45 fits into a channel-shaped depression made in the upper surface of the insulating housing 20 so that the auxiliary leg 45 is practically on the same level with the end sections 22 of the insulating housing 20. As a result, after the main leg 41 of the fastener 40 is inserted and retained in the openings 26 made in the end sections 22 of the insulating housing 20, and the metal shell 30 is placed over the matching surface, the fastening leg 43 becomes resiliently engaged with the lugs 24 of the insulating housing 20, thus securing the insulating housing 20 and the metal shell 30 together. Additionally, the latch 46 of auxiliary leg 45 becomes resiliently engaged with the opening 98 of the metal shell 30, thereby providing an additional mechanical connection between the metal shell 30 and the insulating housing 20, and also providing an electrical connection between the fastener 40 and the metal shell 30. It should be clear that if the overall length of the connector 10 is relatively small, the retaining legs 33*a* will be sufficient to assure a reliable connection with the fastener 40.

The contacts 50 are made by stamping preferably from a 0.25 mm-thick copper plate, and the entire surface of the contacts is nickel plated and at least the portions which are supposed to engage with the matching contacts are gold plated. The portion of contacts 50 which is supposed to be secured in the contact retaining groove 25 of the insulating housing 20 has a retaining device 52 in the form of conventional barbs or other means known in the art. The other end of the contacts 50 is bent at an approximately right angle and protrudes through the bottom of the insulating housing 20 where it forms a soldering tie-in 53. It is preferable to arrange the tie-in ends 53 of each row of the contacts 50 in two staggered rows. In the preferred embodiment, the soldering tie-in sections 53 are arranged in eight rows by deflection from four rows. The front end 54 of the soldering tie-in section 53 is tapered at an angle of 45°.

The tie-in plate 60 is molded from a thick liquid-crystal plastic of a maximum thickness of 2.4 mm, and has at least one stepped recess 61. The tie-in plate 60 has a number of tapered openings 62 which are made in predetermined locations in order to achieve an appropriate deflection and alignment of the tie-in sections 53 of contacts 50. The tie-in plate 60 makes it possible to prevent the misalignment of the tie-in sections 53, whose count can be as high as 240, during the transportation or handling of the connector 10.

Figure 3:
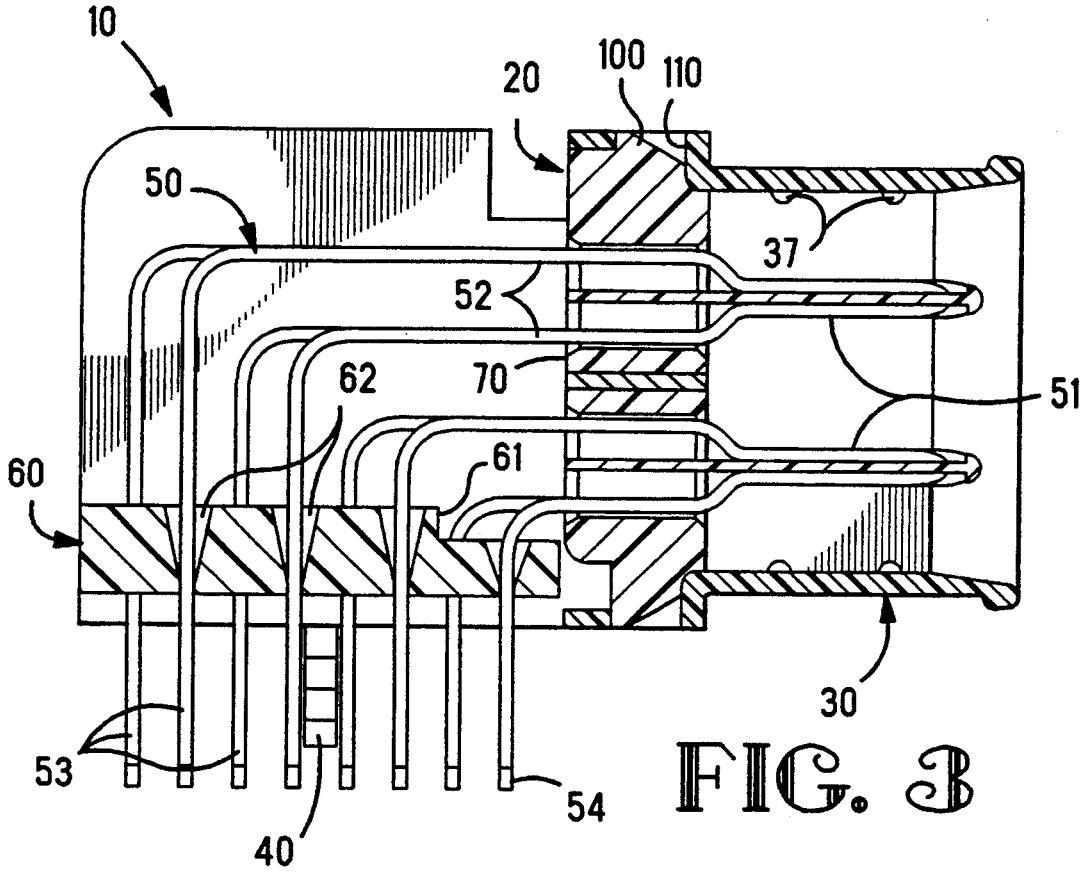
FIG. 3 is a cross-section of the connector taken along line 3—3 in FIG. 1.

As shown in FIG. 3, a grounding strip 70 made of nickel-plated copper sheet of a thickness of approximately 0.3 mm is inserted in the middle of the central section 21 of the insulating housing 20 in order to provide a shield between the contacts. The grounding strip 70 is electrically connected to the metal shell 30 by contact with the inner wall of the tubular section 32. The tubular section 32 of the metal shell 30 is flared in order to facilitate the insertion of the matching connector 10' and has a number of protrusions 37 made on its inner wall to provide for a good electric connection with the matching connector.

Figure 6:
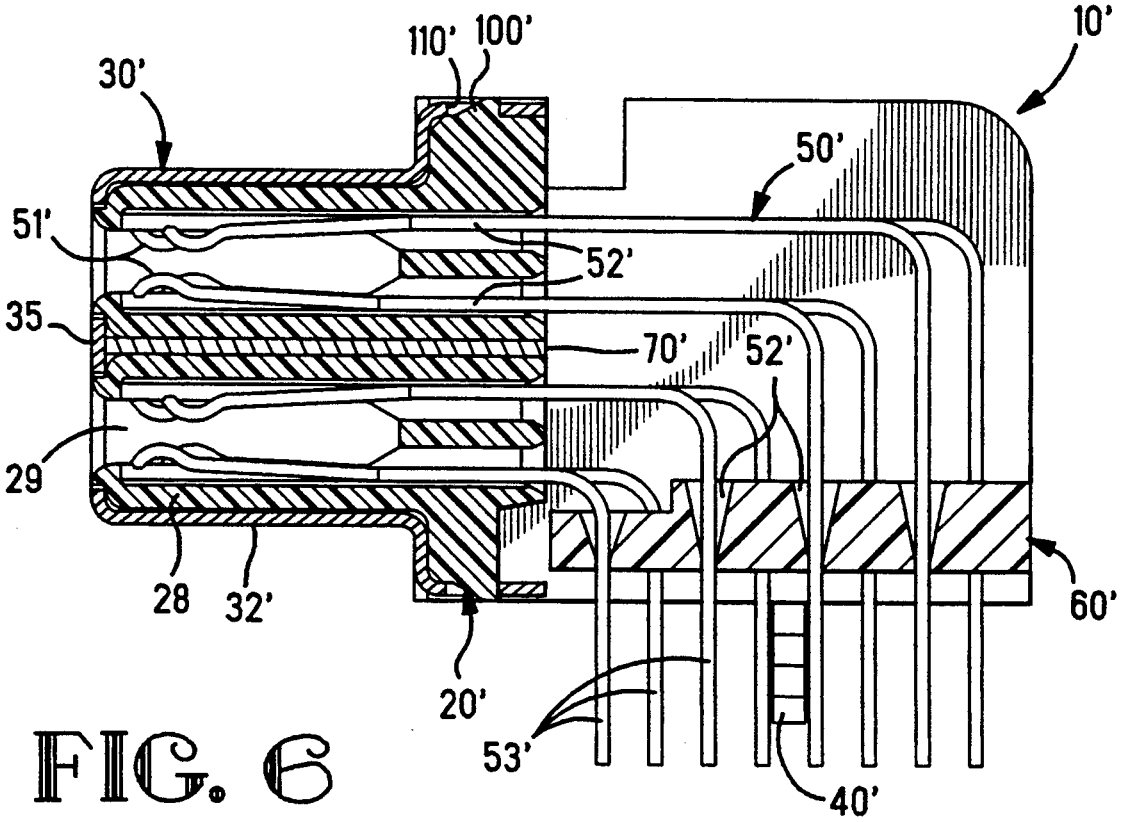
FIG. 6 is a cross-sectional view of the connector of FIG. 5 taken along line 3—3.
Figure 4:
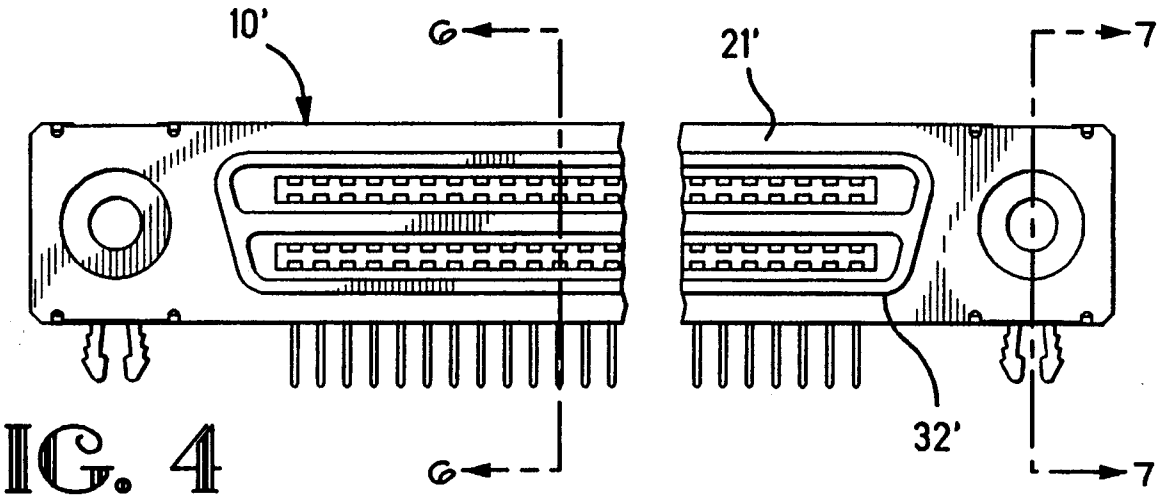
FIG. 4 is a front view of the plug connector for mating with the connector of FIG. 1.
Figure 5:
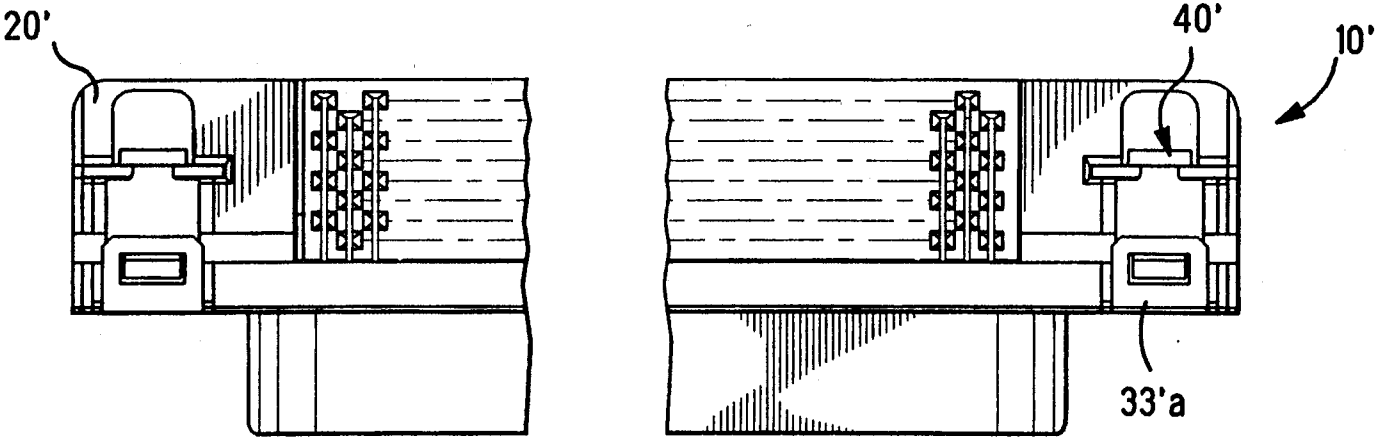
FIG. 5 is a top view of the connector of FIG. 4.

FIGS. 4–6 represent another embodiment of a shielded electrical connector according to this invention. The plug-connector 10' can be used in conjunction with the receptacle-connector 10 shown in FIG. 1.

Figure 2:
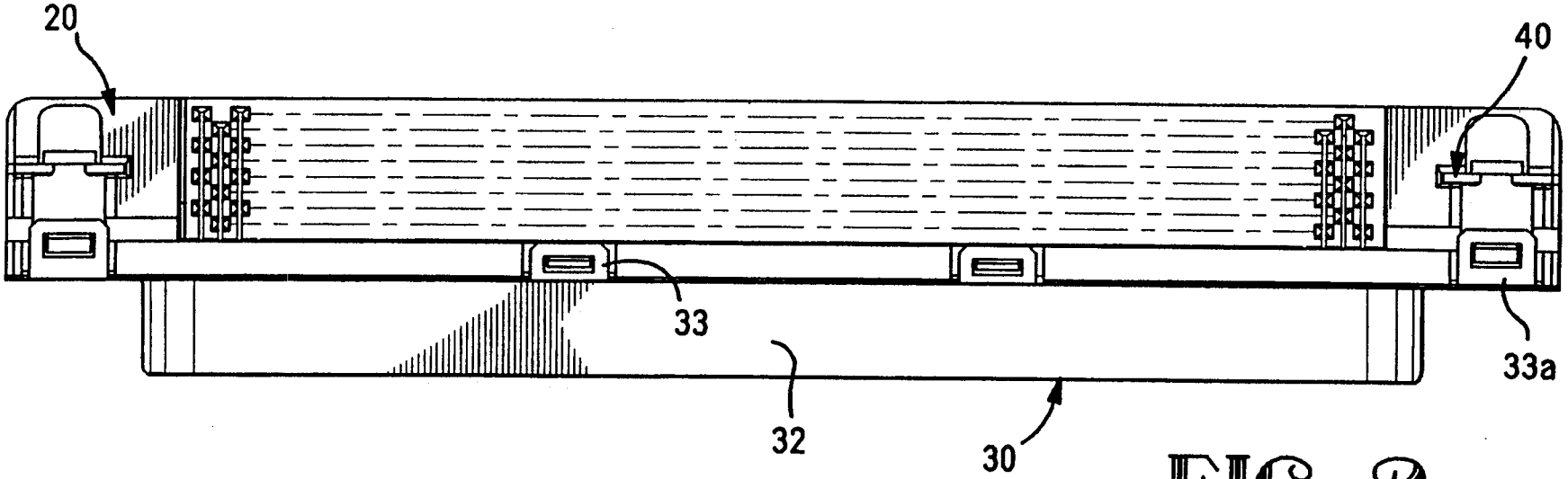
FIG. 2 is the top view of the connector of FIG. 1.

The central section 21' of the insulating housing 20' of the connector 10' has protrusions 28 extending toward the matching surface. The protrusions 28 have two rows of grooves 29. The front edge of the tubular portion 32' of the metal shell 30' is bent so that it can be easily inserted into the matching section of the receptacle-connector 10 shown in FIGS. 1–3. In addition, a horizontal bridge 35 running between the rows of contacts is provided as a part of the D-shaped tubular section 32' of the metal shell 30'. At the time of the insertion of the connector halves, this bridge 35 discharges static electricity accumulated at the receptacle connector, thereby preventing damage being done to the contacts and electrical circuits attached to them. The contacts 50' are of a receptacle type and made preferably of a 0.25 mm thick nickel plated copper strip, and their contacting sections 51' located at their tips are made in the shape of a "C" and are gold-plated. Looking at FIG. 6, the contacting sections 51' have been offset to facilitate the insertion of the receptacle-connector. The contacting sections 51' of contacts 50' are raised slightly above the inner walls of the groove 29 made in the insulating housing 20', so that they may maintain their elasticity. A grounding plate 70' runs along the entire length of the insulating housing 20' between the rows of contacts and the plate, and is in a state of electrical contact with the inner walls of the tubular section 32' and the bridge 35.

By plugging the above-mentioned receptacle connector 10 into the plug-connector 10' the metal shells 30 and 30' are brought into contact, thereby providing for a reliable grounding. Additionally, they form an electrical contact between contacts 50 and 50', whose number can be as high as 240. Further, fasteners 40 and 40' become electrically connected with the metal shells 30 and 30', and the grounding elements are connected to the ground of the printed circuit board when connectors 10 or 10' are attached to their respective circuit boards.

Figure 7:
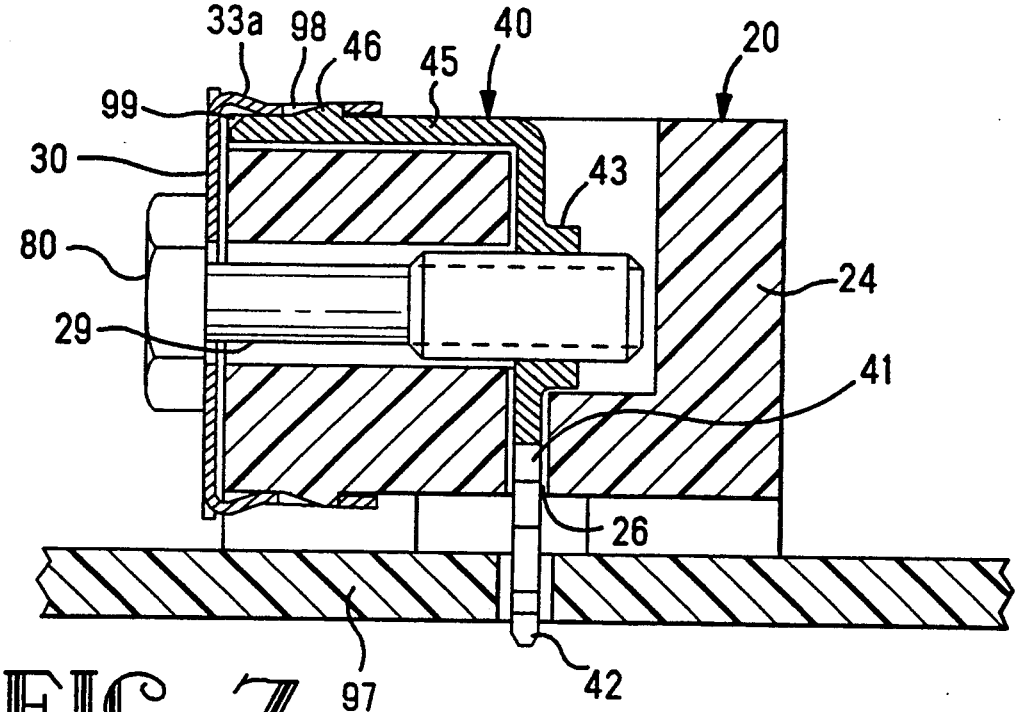
FIG. 7 is a cross-sectional view of the connector of FIG. 4 taken along line 7—7.

FIG. 7 illustrates the relationship between the insulating housing 20, metal shell 30 and fasteners 40. The main leg 41 of the L-shaped fastener 40 is pressed through the opening 26 into the insulating housing 20. The auxiliary leg 45 is inserted into the depression 99 made in the upper surface of the insulating housing 20, and it has a latch 46 provided on the upper surface of its tip. When the metal shell 30 is placed over the housing, its fastening legs 33*a* and the latch 46 of the auxiliary leg 45 become engaged due to the resilient action of the leg 45, thus producing an electrical connection. Fastener 40 is secured in the opening 26 of the insulating housing 20 by means of barbs 44, as are known in the art.

When the connectors 10 or 10′ are used with a panel, they are attached to the panel by means of a bolt 80. The bolt 80, as shown in FIG. 7, passes through the round hole 35 of the metal shell 31, through the opening 29 of the insulating housing 20 and is screwed into the threaded hole 43 of the fastener 40. The electrical connection between the metal shell 30 and the fastener 40 is established by means of the bolt 80; however, it is clear that the electrical connection will exist regardless of the bolt 80. It is preferable that the head of the bolt 80 protrudes from the matching surface of the connector, since it can play the role of a guiding and alignment element.

Figure 8:
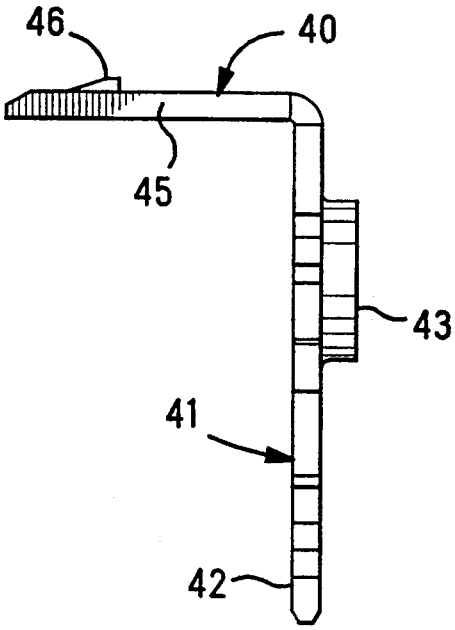
FIG. 8 is a side elevational view of the fastener according to the present invention.
Figure 9:
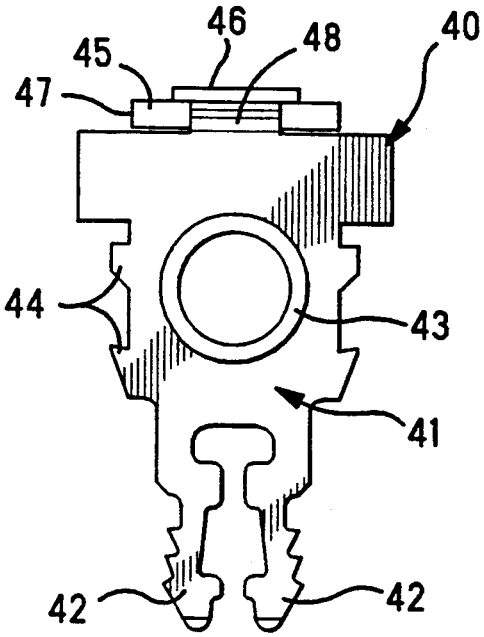
FIG. 9 is a front view of the fastener of FIG. 8.

FIGS. 8–9 illustrate the preferred embodiment of the fastener 40 of the shielded electrical connector. FIG. 8 is the front view of the fastener 40 as seen from the main leg 41; and As mentioned above, the front tip of the main leg 41 has a pair of resilient arms 42. In the middle of the leg there is an opening 43, and the retaining barbs 44. At the other end of the main leg 41, there are two slits 47 forming a neck 48 which facilitates the bending of the auxiliary leg 45. Near the end of the auxiliary leg 45 there is a latch 46 formed at the upper surface of the leg which, during assembly, becomes engaged with the fastening leg 33*a* of the metal shell 30.

The detailed explanations concerning the shielded electrical connector and fastener used with it, which were provided above have been based on this embodiment. However, this invention is not restricted to this embodiment only, but comprises its various modifications as well, without eliminating such elements vital for a reliable grounding between the shell and the fastener.

By using the shielded electrical connector in accordance with this invention, it is possible not only to attach the connector to a printed circuit board by inserting the resilient arms of the L-shaped fastener into an opening or a through-hole made in such a board, but also to obtain a reliable electrical connection of the metal shell to the conducting layer of the board.

We claim:

1. An electrical connector comprising:

an elongated dielectric housing with a plurality of electrical contacts;

said housing being enclosed in a metal shield, said shield having at least one fastener at each end;

wherein a tie-in plate is disposed on the soldering tie-in ends of the contacts, said tie in plate having tapered aperture surfaces for receiving said contacts;

said fastener has a generally planar main leg joined to an auxiliary leg by a deformable, narrowed neck portion and said main leg includes a hole in the plane of said main leg; and wherein said main leg has a pair of resilient arms disposed in said plane for engaging a printed circuit board.

2. The electrical connector of claim 1, wherein the dielectric housing has at least one upwardly extending camming projection which engages an aperture of the metal shield.

3. The electrical connector of claim 1, wherein said deformation forms the fastener into a generally L-shaped member.

4. The electrical connector of claim 1, wherein the auxiliary leg has at least one upwardly extending camming projection for engaging an aperture in the metal shield.

5. The electrical connector of claim 1, wherein the main leg has at least one outwardly extending projection extending from two sides thereof for engaging the dielectric housing.

6. An electrical connector comprising:

an elongated dielectric housing with a plurality electrical contacts;

said housing being enclosed in a metal shield, said shield having at least one fastener at each end;

said fastener has a main leg joined to an auxiliary leg by a deformable, narrowed neck portion;

wherein said main leg has a pair of resilient arms for engaging a printed circuit board;

wherein the dielectric housing has at least one upwardly extending camming projection which engages an aperture of the metal shield.

7. The electrical connector of claim 6, wherein deformation of said narrowed neck portion forms the fastener into a generally L-shaped member.

8. The electrical connector of claim 6, wherein the auxiliary leg has at least one upwardly extending camming projection for engaging an aperture in the metal shield.

9. The electrical connector of claim 6, wherein the main leg has at least one outwardly extending projection extending from two sides thereof for engaging the dielectric housing.

10. An electrical connector comprising:

an elongated dielectric housing with a plurality electrical contacts;

said housing being enclosed in a metal shield, said shield having at least one fastener at each end;

said fastener has a main leg joined to an auxiliary leg by a deformable, narrowed neck portion; and wherein the auxiliary leg has at least one upwardly extending camming projection which engages an aperture in the metal shield.

11. The electrical connector of claim 10, wherein said deformation forms the fastener into a generally L-shaped member.

12. The electrical connector of claim 10, wherein said main leg has a pair of resilient arms for engaging a printed circuit board.

13. The electrical connector of claim 10, wherein the main leg has at least one outwardly extending projection extending from two sides thereof for engaging the dielectric housing.

* * * * *

UNITED STATES PATENT AND TRADEMARK OFFICE

CERTIFICATE OF CORRECTION

PATENT NO. : 5,356,313

DATED : October 18, 1994

INVENTOR(S) : Takeo Niwa, et al

It is certified that error appears in the above-indentified patent and that said Letters Patent is hereby corrected as shown below:

Column 6, line 50, claim 10, delete "which engages" and insert --for engaging--

Signed and Sealed this

Second Day of May, 1995

Bruce Lehman

*Attest:*

BRUCE LEHMAN

*Attesting Officer*

*Commissioner of Patents and Trademarks*